US007437847B1

(12) United States Patent
Mabry

(10) Patent No.: US 7,437,847 B1
(45) Date of Patent: Oct. 21, 2008

(54) PIVOTABLE SHOULDER STOCK FOR A HANDGUN

(76) Inventor: James B. Mabry, 1932 Gerringer Mill Rd., Burlington, NC (US) 27217

( * ) Notice: Subject to any disclaimer, the term of this patent is extended or adjusted under 35 U.S.C. 154(b) by 95 days.

(21) Appl. No.: 11/589,538

(22) Filed: Oct. 30, 2006

(51) Int. Cl.
*F41C 23/12* (2006.01)
*F41C 23/14* (2006.01)

(52) U.S. Cl. ..... 42/71.02; 42/73; 42/94

(58) Field of Classification Search ..... 42/71.02, 42/72, 73, 75.02, 75.04, 94
See application file for complete search history.

(56) References Cited

U.S. PATENT DOCUMENTS 3,052,053 A 9/1962 Vartanian
3,262,440 A * 7/1966 Kuhn ..... 124/67
3,388,494 A 6/1968 Kimball
3,685,828 A * 8/1972 Getgey et al. ..... 273/356
4,559,737 A * 12/1985 Washington ..... 43/59
5,225,613 A 7/1993 Claridge
5,351,428 A 10/1994 Graham
6,276,085 B1 * 8/2001 Wooten et al. ..... 42/1.08
6,543,173 B1 * 4/2003 Golan ..... 42/75.04
6,560,911 B2 5/2003 Sharp
6,805,111 B2 * 10/2004 Tippmann, Jr. ..... 124/74
6,901,691 B1 * 6/2005 Little ..... 42/118
7,024,812 B2 4/2006 Nelson

OTHER PUBLICATIONS

Eight (8) page printout from the website, www.israeli-weapons.com, showing the "Corner Shot"; undated.
U.S. Appl. No. 10/954,776, filed Sep. 30, 2004, Ballard.

* cited by examiner

*Primary Examiner*—Bret Hayes

(57) ABSTRACT

A pivotable shoulder stock for a handgun allows the user to aim and fire a handgun around the corner of a building or other obstacle. The user is able to fire with relative accuracy from behind a building or other obstacle using a mirror attached to the shoulder stock. The mirror can be adjustably positioned for viewing in order to fire the handgun at about a ninety degree (90°) angle in either a clockwise or counterclockwise direction. The mirror can be removed when firing the handgun in a linear direction similar to a rifle or for storage purposes. The pivotable shoulder stock is relatively simple to operate and can be quickly adjusted while under assault conditions.

14 Claims, 16 Drawing Sheets

PIVOTABLE SHOULDER STOCK FOR A HANDGUN

FIELD OF THE INVENTION

The invention herein pertains to a shoulder stock for mounting a handgun and particularly pertains to a pivotable shoulder stock to permit selective rotation of the handgun for use in firing around the corner of a building or other structure.

DESCRIPTION OF THE PRIOR ART AND OBJECTIVES OF THE INVENTION

Urban violence has increased in recent years requiring policemen and law enforcement personnel to encounter and subdue violent offenders many of which carry pistols, rifles and other weapons. In addition, many military operations occur in urban areas requiring soldiers to patrol towns and cities. During such encounters many police and military personnel must often take cover behind cars, houses, buildings and the like and to fire their weapons at close range around such structures which often obliterate a clear view of the target. In such instances it is advantageous to have a weapon which will allow visible ninety degree (90°) firings, that is, the ability to fire a weapon accurately around the corner of a building or other obstacle without exposure. One weapon of choice is a pistol mount in the form of a shoulder stock with an attached mirror. Such a device is the Israeli Corner Shot™ which utilizes a color video monitor, folding stock and various other accessories. Due to the many high-tech electronic components employed, the price of the Israeli Corner Shot™ is very high and unaffordable for many police and other departments. Repair and service can also make the Israeli Corner Shot™ impractical for small law enforcement agencies. Thus, based on the needs and budgets of many current police departments, the present invention was conceived and one of its objectives is to provide a pivotable shoulder stock for a standard handgun.

It is another objective of the present invention to provide a pivotable shoulder stock which can be easily assembled, adjusted and repaired on site as needed.

It is still another objective of the present invention to provide a pivotable shoulder stock for a handgun which allows the user to make corner shots quickly and accurately by using the attached mirror.

It is yet another objective of the present invention to provide a pivotable shoulder stock for a handgun which can be adjusted to any of a variety of angular positions, depending on the particular situation at hand.

It is yet a further objective of the present invention to provide a pivotable shoulder stock for a handgun which is relatively inexpensive to manufacture, sell and service and which is lightweight for convenient manual carrying.

Various other objectives and advantages of the present invention will become apparent to those skilled in the art as a more detailed description is set forth below.

SUMMARY OF THE INVENTION

The aforesaid and other objectives are realized by providing an adjustable shoulder stock for use with a handgun, such as a 45 caliber automatic pistol as used by U.S. army, various police departments and other agencies. The shoulder stock is comprised of two (2) main sections, a handgun section and a shoulder section. The shoulder stock is foldable for convenience in transportation and storage. A mirror is affixed at the intersection of the shoulder section and the handgun section and can be rotated for visibility in aiming at different targets by the user. The handgun section and the shoulder section are each formed from a planar metal such as aluminum and are pivotably joined. The handgun section can be pivoted to about either a left or a right ninety degree (90°) position for example when firing the handgun around the corner of a building for use in urban areas. A pin mounted on the shoulder section can be removed to allow the handgun section to pivot as desired. The pin is then replaced to lock the handgun section at a particular angle relative to the shoulder section. A brace which includes a handle is releasably affixed to the shoulder and handgun sections. The brace is provided to stabilize the shoulder stock for shooting accuracy when the handgun section is positioned at ninety degrees (90°). A stock handle is affixed to the shoulder section proximate the stock trigger for additional stability when aiming and firing.

In order to fire the handgun which can be clamped or affixed with straps to the handgun section, a trigger mechanism is provided. The trigger mechanism includes in one embodiment a stock trigger, a trigger spring, a first rod, a circular crank comprising a series of apertures, a second rod and a trigger lever. The stock trigger is pivotably mounted to the shoulder section and includes an aperture for receiving one end of the first rod. The trigger spring is positioned at the proximate end of the first rod and the opposite end of the trigger spring is attached to the shoulder section. The distal end of the first rod is received in one of the apertures provided in the circular crank. The second rod is received in a different aperture of the crank and extends to the trigger lever pivotably mounted in the handgun section. The crank is rotatably positioned at the intersection of the shoulder section and handgun section. The trigger lever is positioned through the trigger guard of the handgun mounted on the handgun section. By pulling the stock trigger for firing the first rod is pulled causing the crank to rotate thereby pulling the second rod which actuates the trigger lever situated proximate the handgun trigger, causing the handgun to fire. The trigger spring which extended upon pulling the stock trigger then contracts and returns the stock trigger to its normal position after firing.

The shoulder stock can be quickly changed and adjusted during field or combat operations which may include exchanging one handgun for another or changing the angular alignment of the handgun section relative to the shoulder section.

DETAILED DESCRIPTION OF THE PREFERRED EMBODIMENT AND OPERATION OF THE INVENTION

Figure 1:
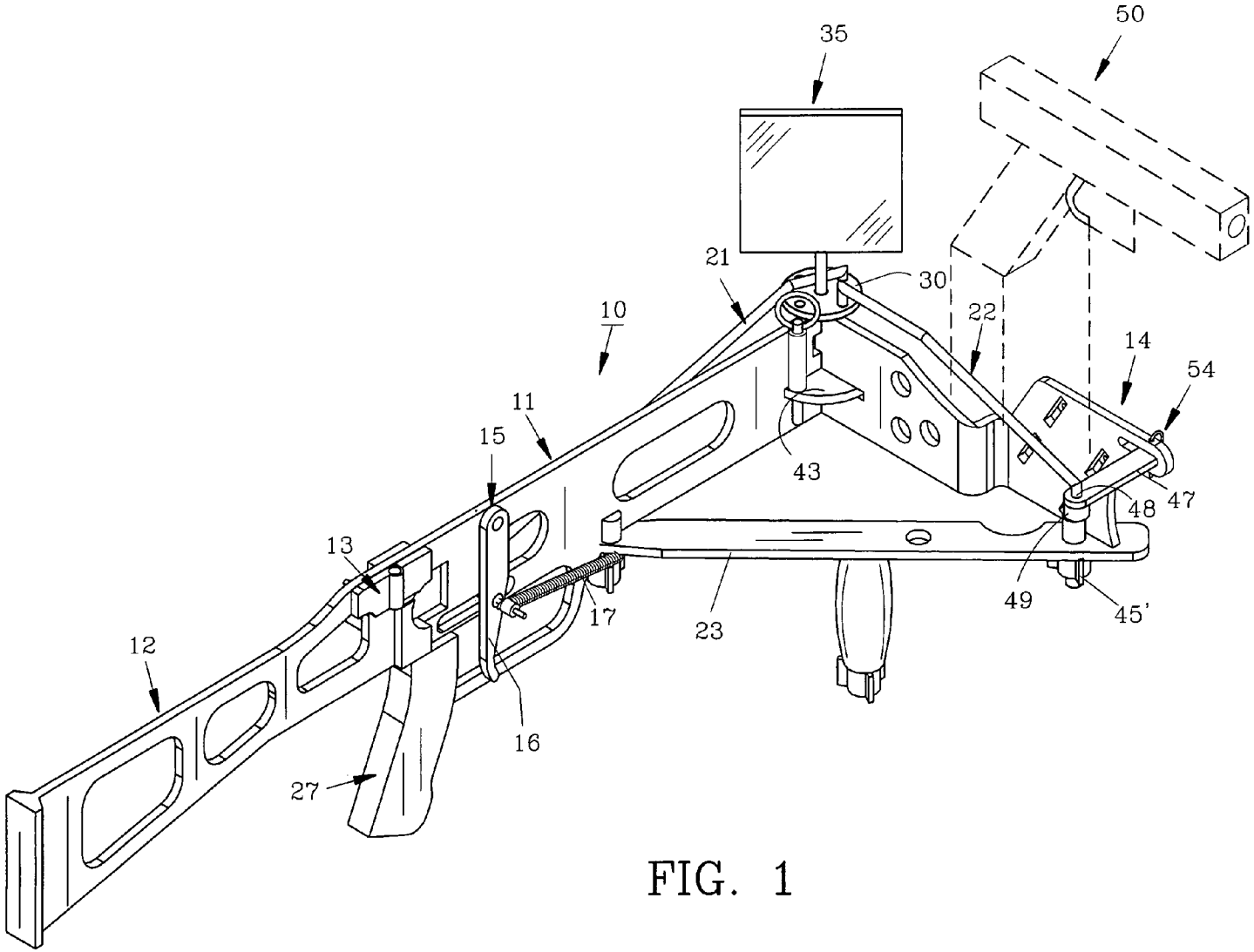
FIG. 1 shows a top, rear, left side perspective view of a pivotable shoulder stock of the invention with the handgun section rotated clockwise approximately ninety degrees (90°) and a handgun exploded therefrom.
Figure 3:
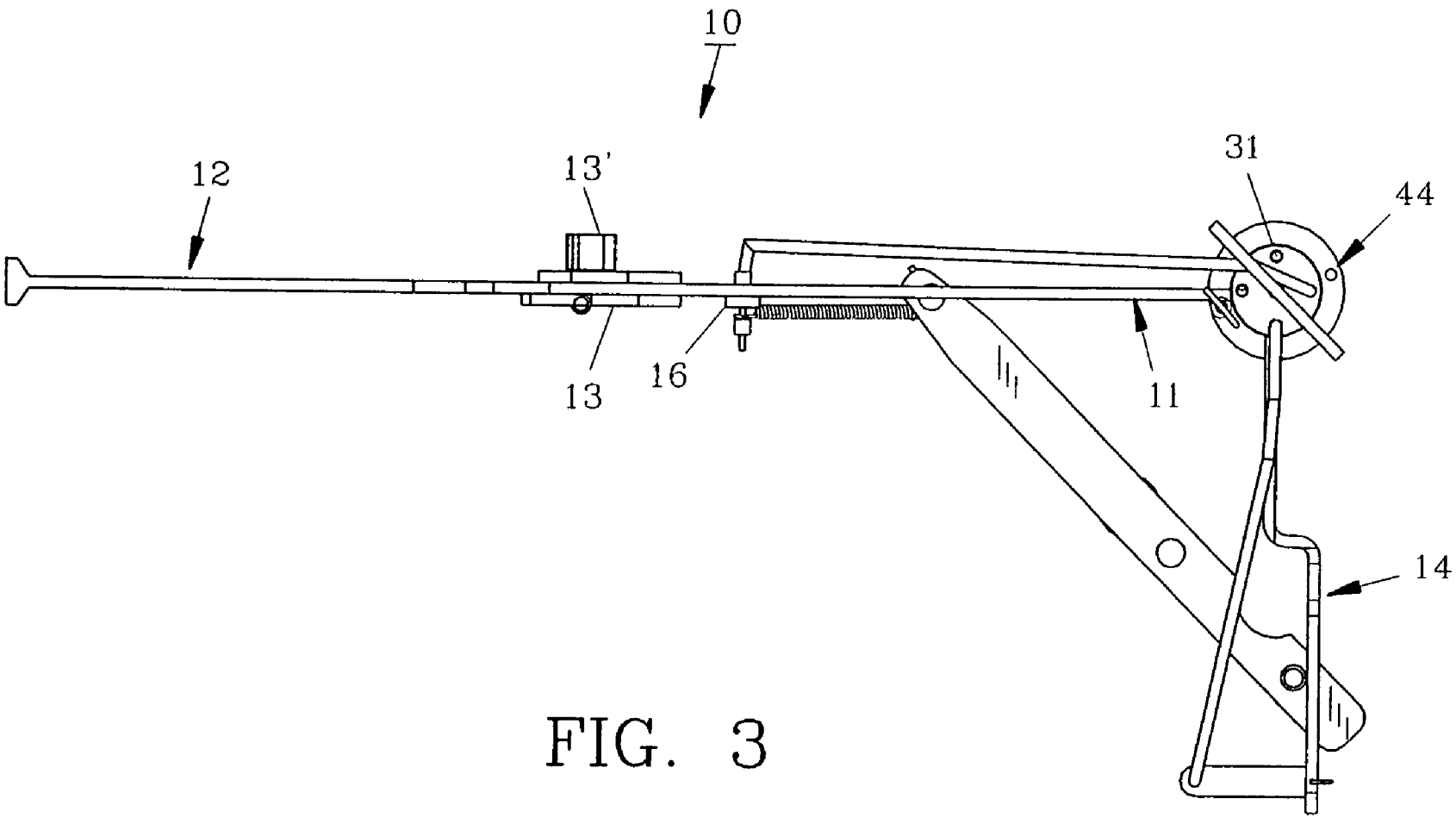
FIG. 3 features a top plan view of the pivotable shoulder stock as seen in FIG. 1.

For a better understanding of the invention and its operation, turning now to the drawings, one embodiment of the invention is seen as shoulder stock 10 in FIG. 1 having handgun section 14, first shoulder section 11 and second shoulder section 12. Shoulder section 12 is in linear alignment and pivotably joined to first shoulder section 11 by attached hinge 13 and locked in place by conventional wingnut 13' (FIG. 3). First shoulder section 11 and second shoulder section 12 are preferably formed from generally planar metal such as aluminum although steel or other suitable composites or polymeric materials could likewise be used. The weight of shoulder stock 10 is reduced by openings shown therein. Handgun section 14 is shown in FIG. 1 rotated at an angle about ninety degrees (90°) from first shoulder section 11 for aiming and firing for example at targets which are located at about ninety degrees (90°), such as around a building, corner or other obstacle. In order to view the target mirror 35 is provided and is rotatably positioned at the intersection of first shoulder section 11 and handgun section 14. Second shoulder section 12 is positioned against the user's shoulder during use of a handgun such as pistol 50 shown in dotted line in FIG. 1.

Figure 2:
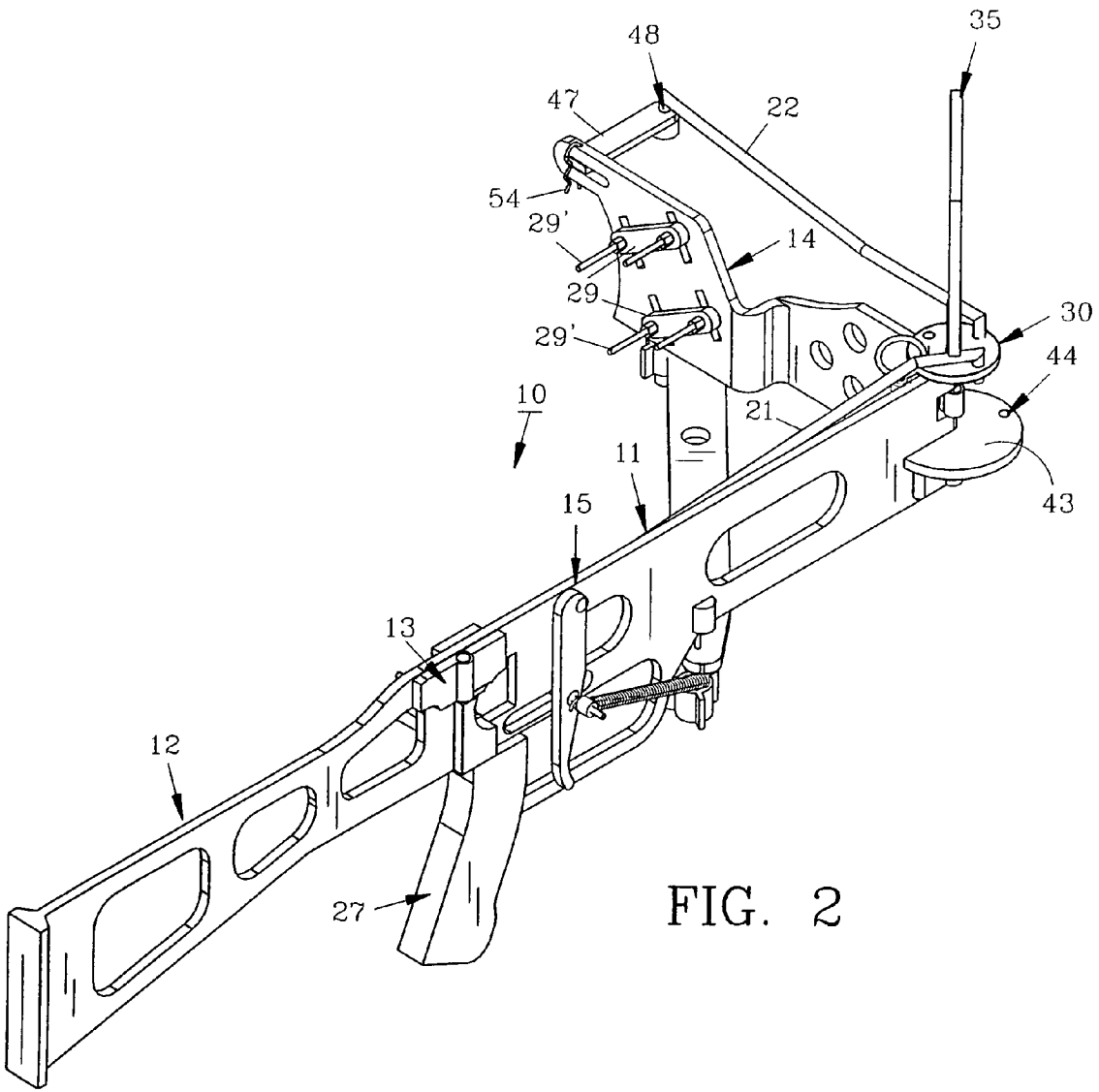
FIG. 2 illustrates the pivotable shoulder stock as seen in FIG. 1 without the handgun and with the handgun section rotated counterclockwise approximately one hundred eighty degrees (180°)
Figure 9B:
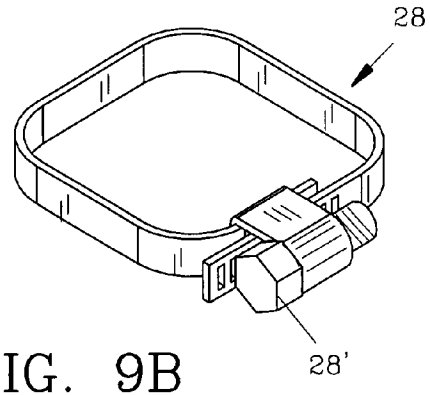
FIG. 9B depicts an enlarged version of a steel strap as may be used in place of a clamp for retaining the handgun.
Figure 9A:
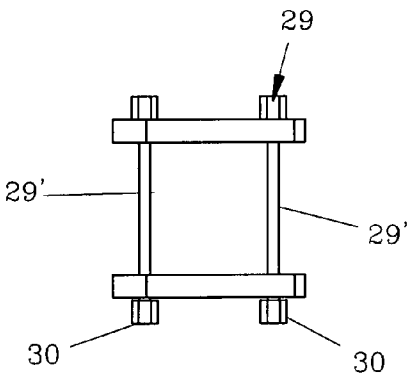
FIG. 9A features a top plan view of a clamp as used on the handgun section, also seen in FIG. 2.

Handgun section 14 includes a series of four (4) biased slots 41 (FIGS. 6 and 7) which allow a pair of adjustable clamps 29 having threaded members 29' received by nuts 30 shown in FIGS. 2 and 9A to retain a handgun such as 45 caliber pistol 50 (shown schematically in FIG. 1). As an alternative means of retaining pistol 50 to handgun section 14, a pair of straps such as standard metal strap 28 having adjustable bolt 28' as shown enlarged in FIG. 9B can be positioned in mounting slots 41. Conventional strap 28 is formed from metal but other types and composite straps may be used as suitable. As would be understood, by rotating strap bolt 28' clockwise strap 28 is tightened around the handle of pistol 50 to secure it through slots 41 to handgun section 14.

Figure 10:
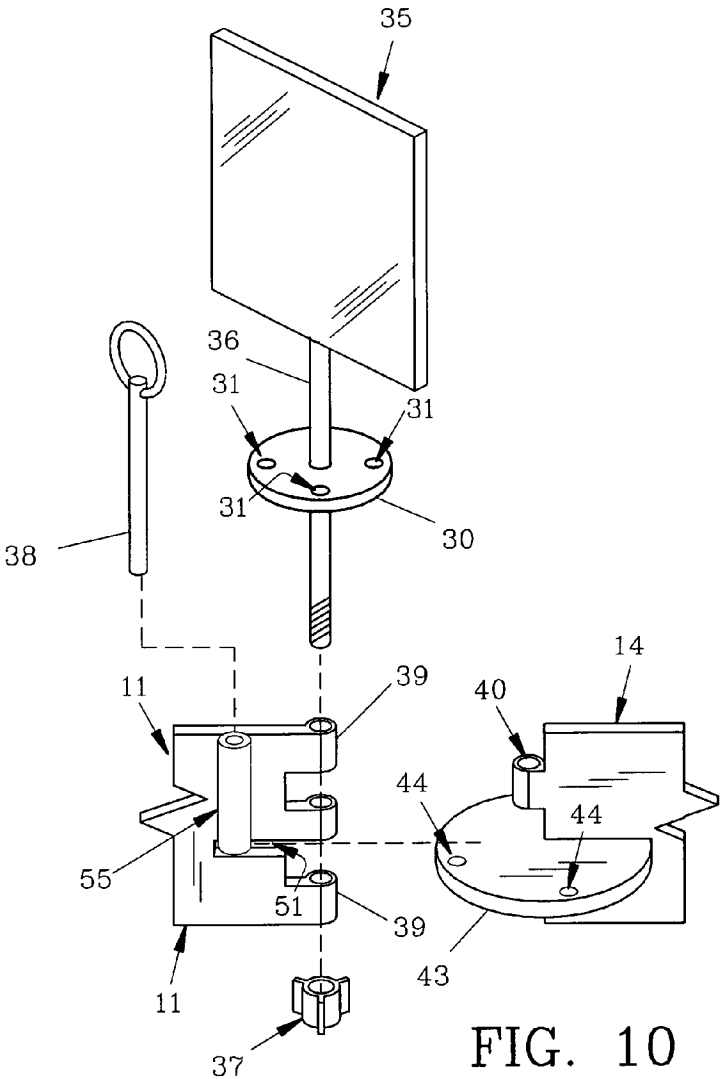
FIG. 10 illustrates a fragmented, exploded view of the mirror and crank as affixed to the shoulder section and the handgun section of the pivotable shoulder stock.

For aiming pistol 50, mirror 35 as illustrated in FIGS. 1 and 2 is manually positioned at different angles depending on the exact alignment of handgun section 14 relative to first shoulder section 11. In FIG. 10 an enlarged fragmented view illustrates the pivotable connection of shoulder section 11 and handgun section 14 with circular crank 30 exploded therefrom and locking pin 38 removed. Locking pin 38 is selectively positioned through sleeve 55 on first shoulder section 11 and in one of apertures 44 in disk 43. Disk 43 is rigidly affixed to handgun section 14 such as by welding or the like and is rotatable in slot 51 of first shoulder section 11. Once the desired angle of handgun section 14 is chosen, pin 38 is then placed through sleeve 55 on shoulder section 11 and into the selected aperture 44 for locking purposes. To change the relative positioning of handgun section 14 and first shoulder section 11, pin 38 is removed from aperture 44, handgun section 14 rotated as desired and pin 38 replaced in another one of the apertures 44 as seen in FIG. 10. Shoulder stock 10 can also be adjusted to a linear configuration as seen in FIGS. 8, 8A-8D for using pistol 50 like a rifle. In this position mirror 35 could be removed and rods 21, 22 adjusted as required to a proper length in position on crank 30 for firing purposes.

As further shown in FIG. 10, mirror 35 is attached to threaded shaft 36 which in turn passes through crank 30, channels 39 and 40 of respectively, shoulder section 11 and handgun section 14. Shaft nut 37 is then tightened on shaft 36. As would be understood, by loosening shaft nut 37 and removing pin 38, mirror 35 and handgun section 14 are rotatable relative to first shoulder section 11. First rod 21 and second rod 22 can then be adjusted as required such as by bending for placement in crank apertures 31 for the selected angle of firing.

Figure 4:
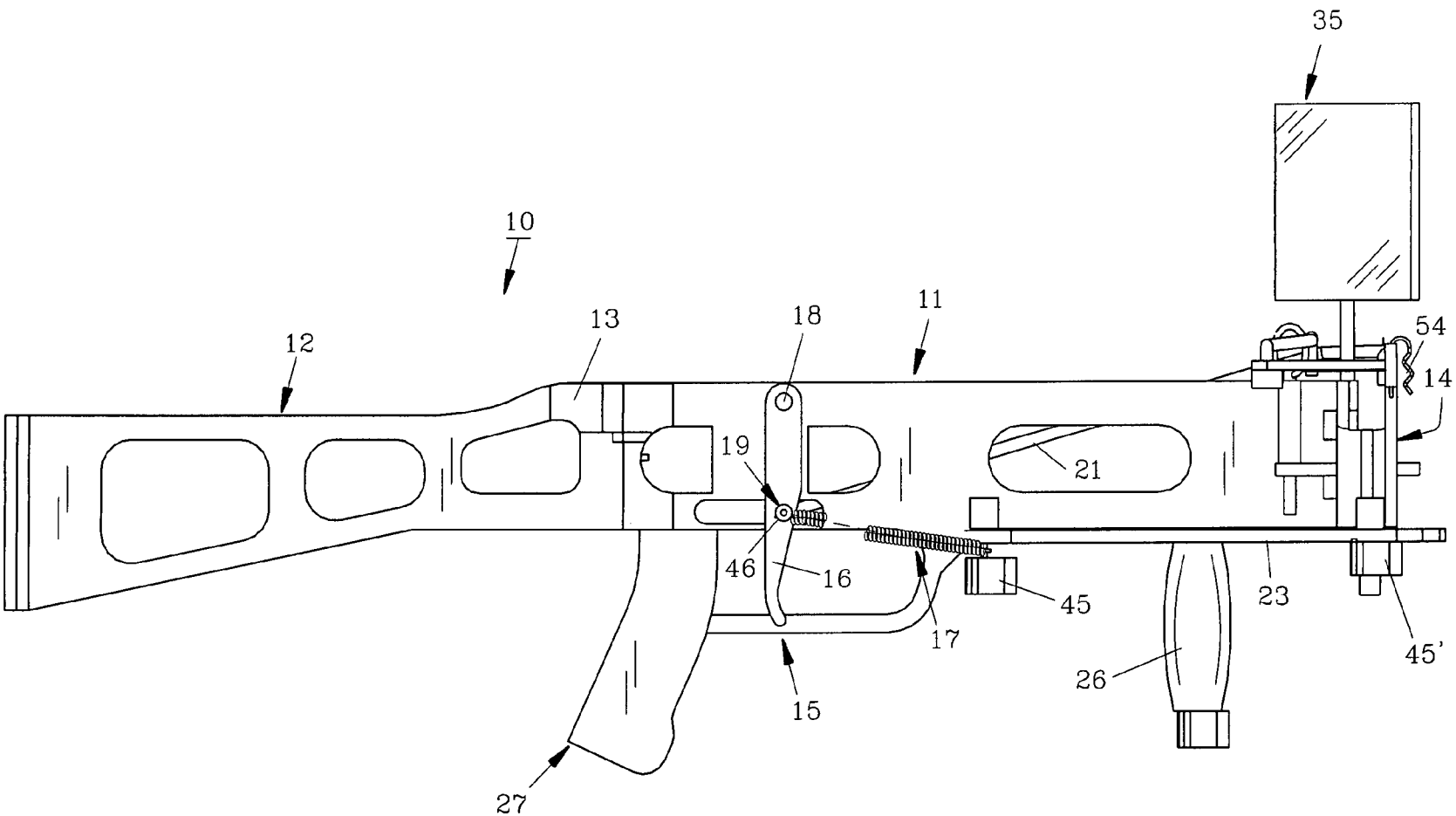
FIG. 4 depicts a left side elevational view of the pivotable shoulder stock as shown in FIG. 1.
Figure 5:
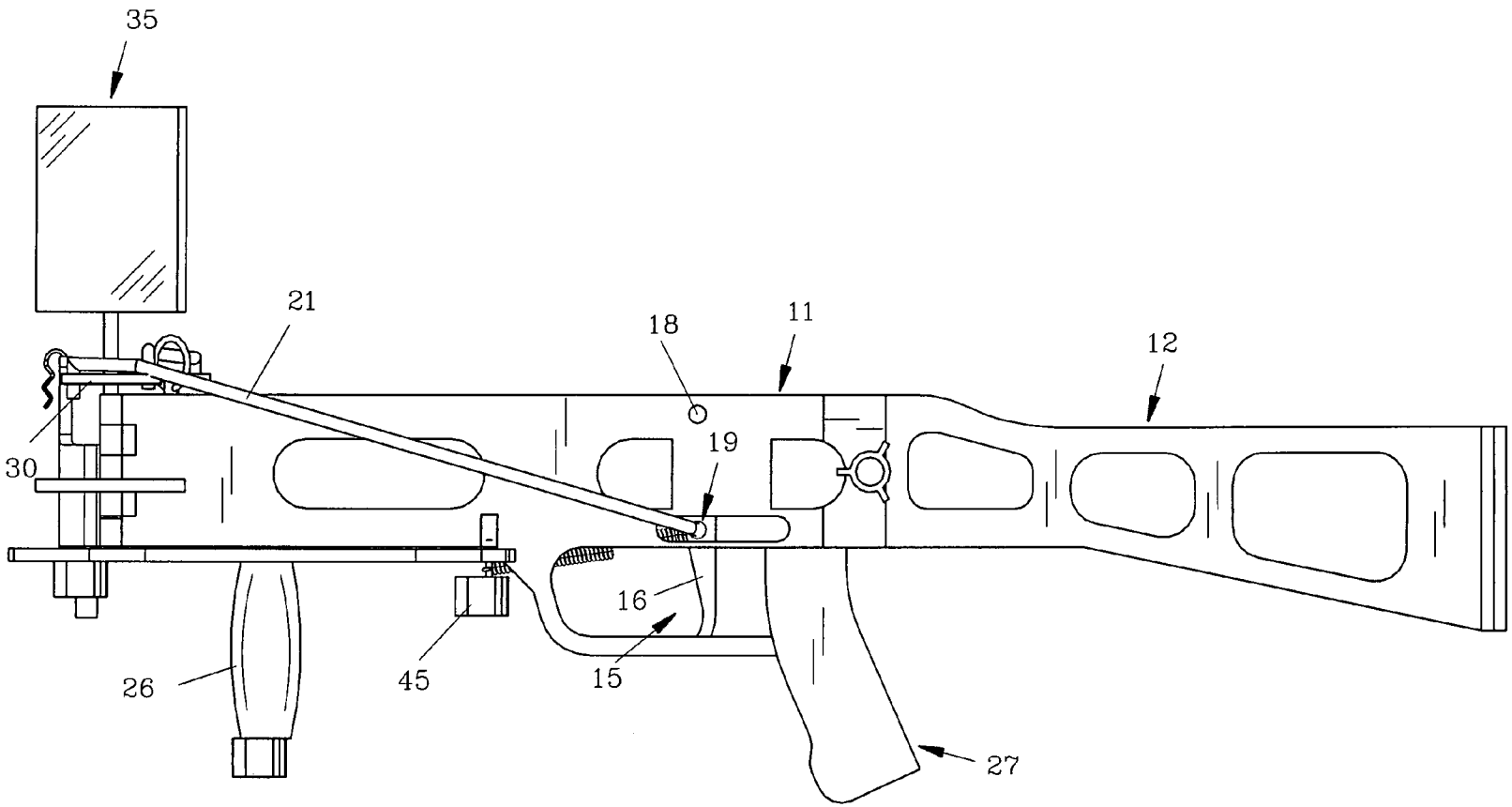
FIG. 5 shows a right side elevational view of the pivotable shoulder stock as shown in FIG. 1.
Figure 7:
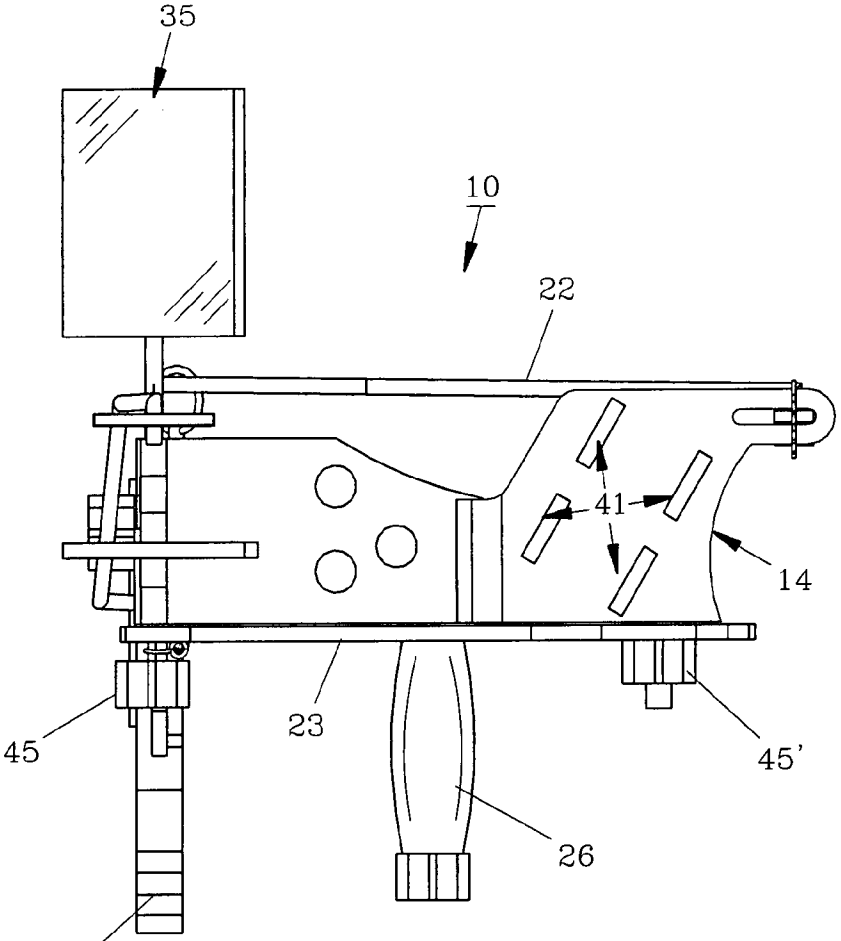
FIG. 7 demonstrates a front elevational view of the pivotable shoulder stock as shown in FIG. 2.
Figure 8:
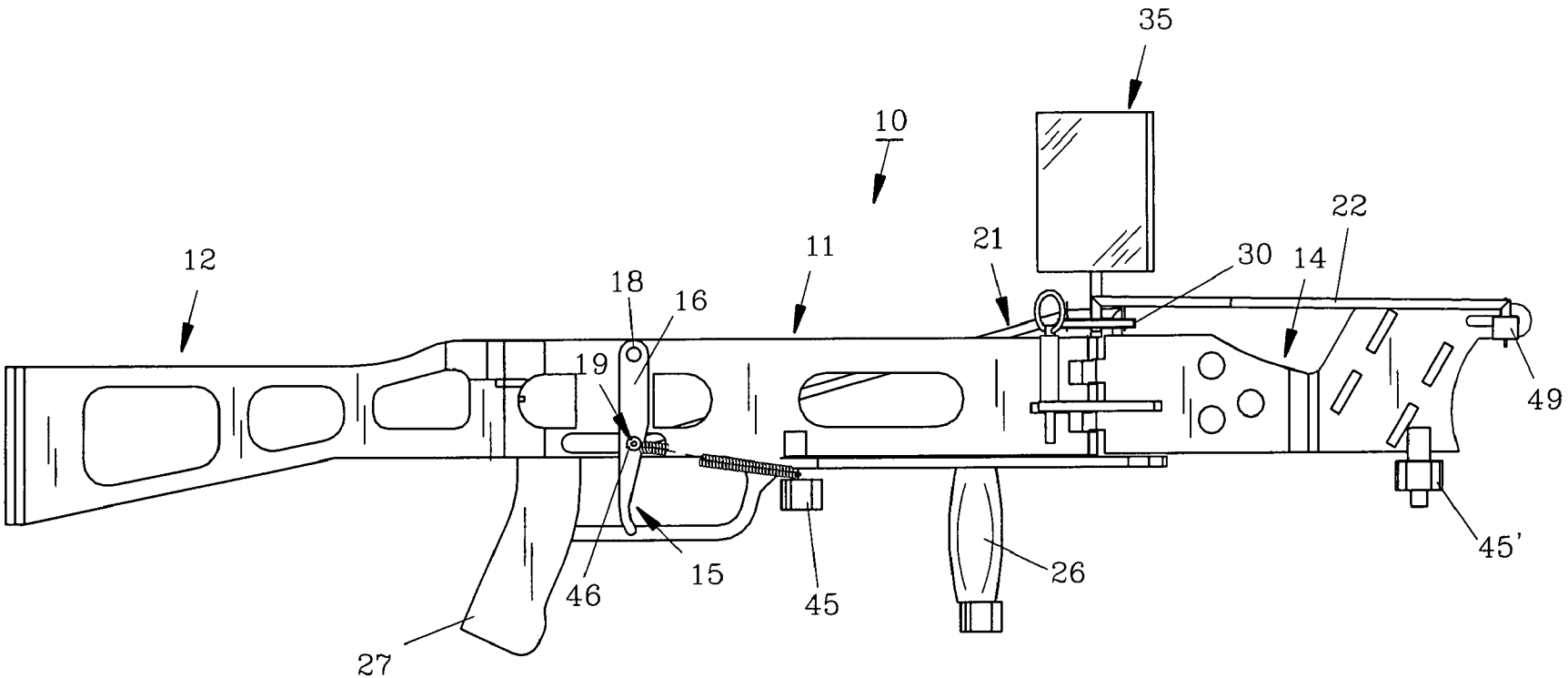
FIG. 8 features a left side elevational view of the pivotable shoulder stock with the handgun section rotated counter-clockwise ninety degrees (90°) from that shown in FIG. 1.
Figure 8A:
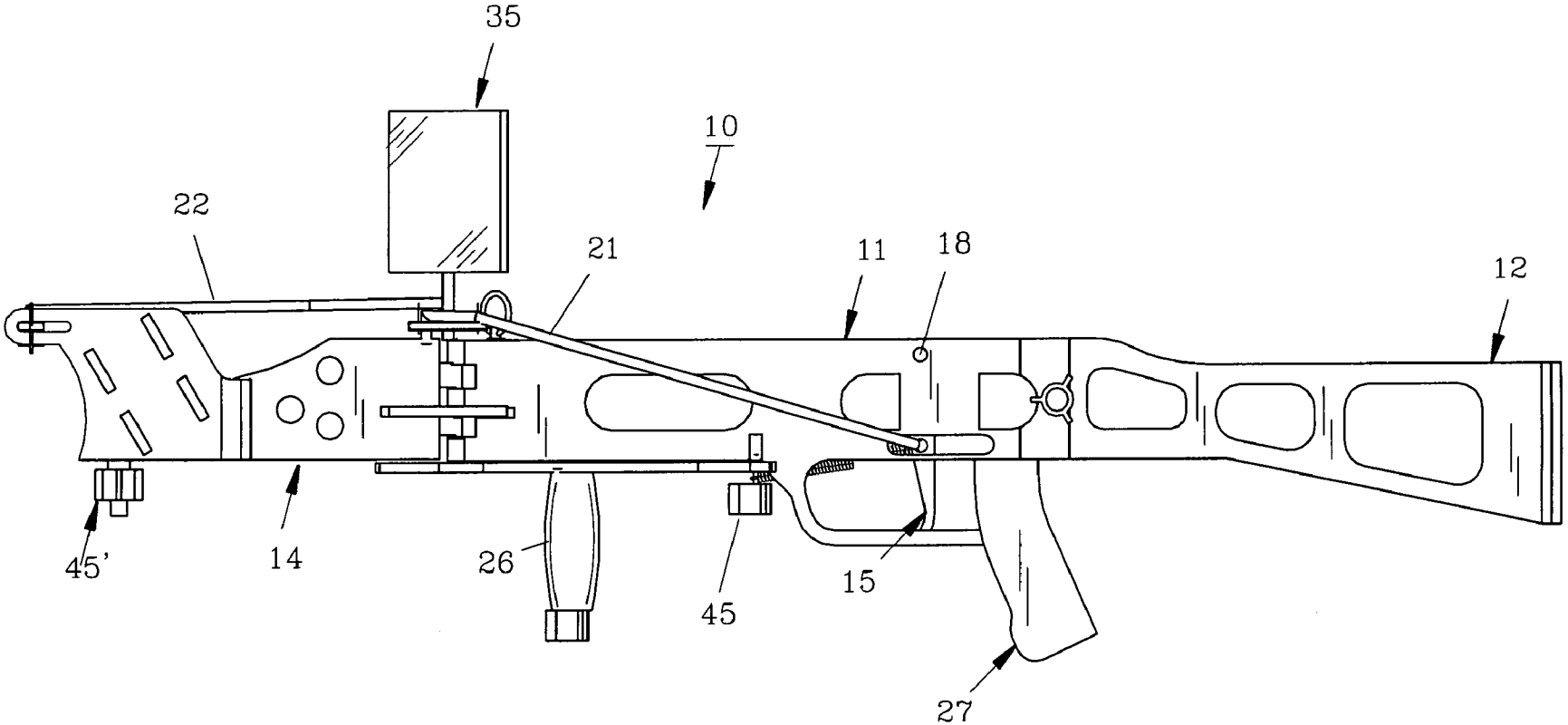
FIG. 8A features a right side elevational view of the pivotable shoulder stock as shown in FIG. 8.
Figure 8B:
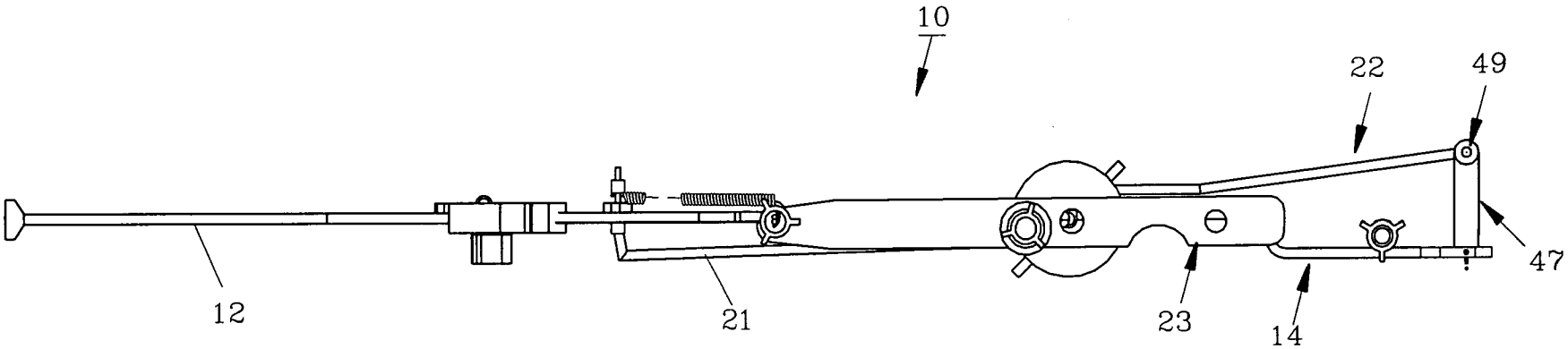
FIG. 8B illustrates a bottom plan view of the pivotable shoulder stock as shown in FIG. 8.
Figure 8C:
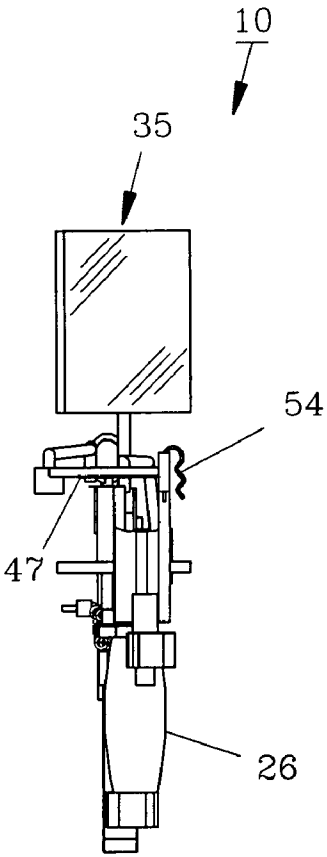
FIG. 8C depicts a front elevational view of the pivotable shoulder stock as shown in FIG. 8.
Figure 8D:
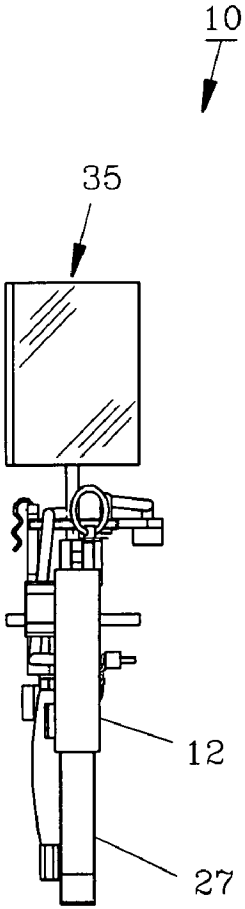
FIG. 8D demonstrates a rear elevational view of the pivotable shoulder stock as shown in FIG. 8.

Trigger mechanism 15 seen in FIGS. 3-8 includes stock trigger 16 pivotably affixed to first shoulder section 11 by trigger axle 18 (FIG. 4). Trigger spring 17 is a conventional coil spring affixed to trigger 16 and winged bolt 45. Bolt 45 is threadably received in the bottom of first shoulder section 11. Stock trigger 16 includes rod opening 19 for reception of the proximal end of first rod 21 as shown in FIG. 5. Rod 21 has an L-shaped proximal end which passes through trigger 16 and spring 17 and is held therein by conventional nut 46 (FIG. 8). First rod 21 as seen is configured having a bent distal end which passes through one of crank apertures 31 in crank 30 as seen in FIGS. 3 and 10. First rod 21 is preferably formed from a rigid steel as is second rod 22 which, as shown in FIGS. 7, 8, 8A and 8B is also positioned in one of crank apertures 31 and extends to trigger lever 47 as seen in FIGS. 1, 2, 8B and 8C. Trigger lever 47 includes aperture 48 through which second rod 22 passes and is held therein by preferably standard nut 49 as shown in FIGS. 1, 2 and 8B. A usual metal clip could also be used in place of nut 49. Trigger lever 47 is pivotably affixed to handgun section 14 as shown in FIGS. 1 and 2 by standard spring clip 54 which passes through a channel (not shown) in handgun section 14 and also through an aperture (not shown) in trigger lever 47.

Trigger lever 47 thus rotates on one leg of spring clip 54 as seen in FIG. 4. During the mounting of pistol 50 trigger lever 47 is fitted inside the trigger guard (not shown) of pistol 50 in front of the pistol trigger (not shown). The method of firing pistol 50 includes manually pulling stock trigger 16 as in normal firing causing stock trigger 16 to rotate, pulling first rod 21 to turn crank 30 in a counterclockwise direction as shown in FIG. 1. The rotation of crank 30 urges second rod 22 towards crank 30 thereby pivoting trigger lever 47 rearwardly and applying pressure to the trigger (not shown) of pistol 50 causing pistol 50 to fire. Crank 30 is shown as circular, but could have various shapes, such as an "X" shape, rectangle or otherwise as desired.

Figure 6:
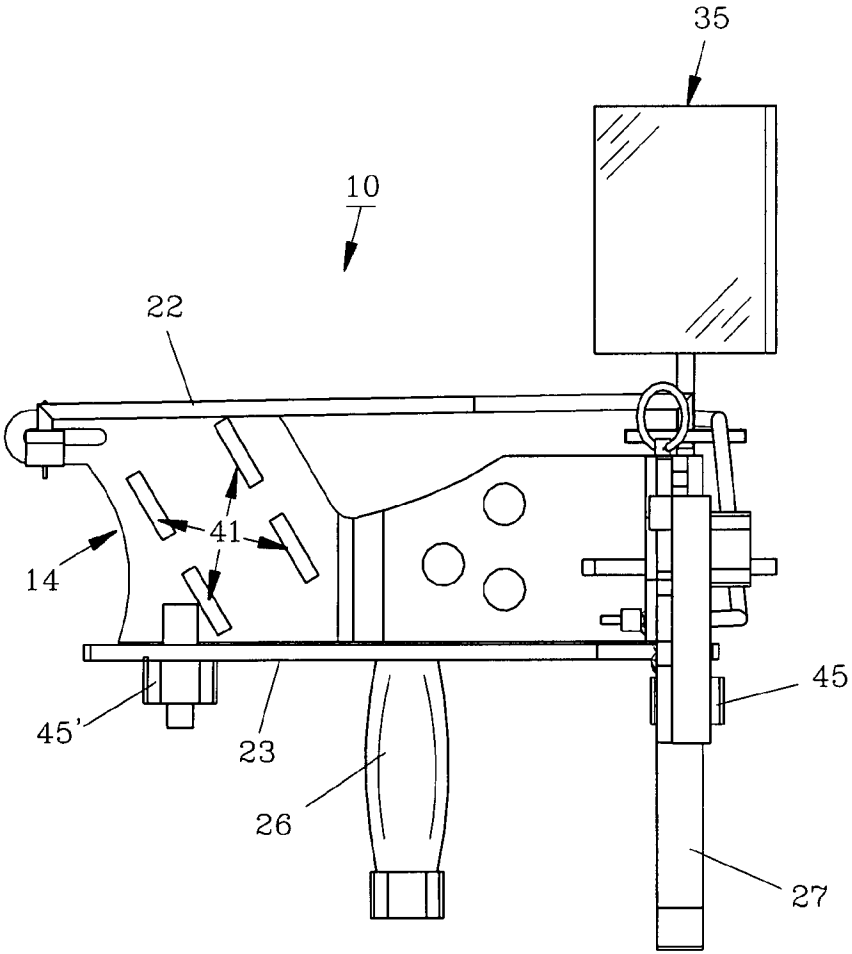
FIG. 6 pictures a rear elevational view of the pivotable shoulder stock as shown in FIG. 2.

For additional stability and accuracy in firing shoulder stock 10, brace 23 as seen in FIGS. 1 and 2 is adjustably tightenable between first shoulder section 11 and handgun section 14 of shoulder stock 10. Wing bolts 45, 45' as shown in FIGS. 4, 6 and 7 secure brace 23 to respectively shoulder section 11 and handgun section 14. Brace 23 includes brace handle 26 for gripping purposes during firing in addition to stock handle 27 as seen in FIGS. 1, 2, 4, 5, 6 and 7.

During storage shoulder stock 10 can be folded at hinge 13 and at the intersection of handgun section 14 and front shoulder section 11 for compactness by shortening the overall length thereof. Rods 21 and 22 can be disengaged during folding and storage.

Figure 11:
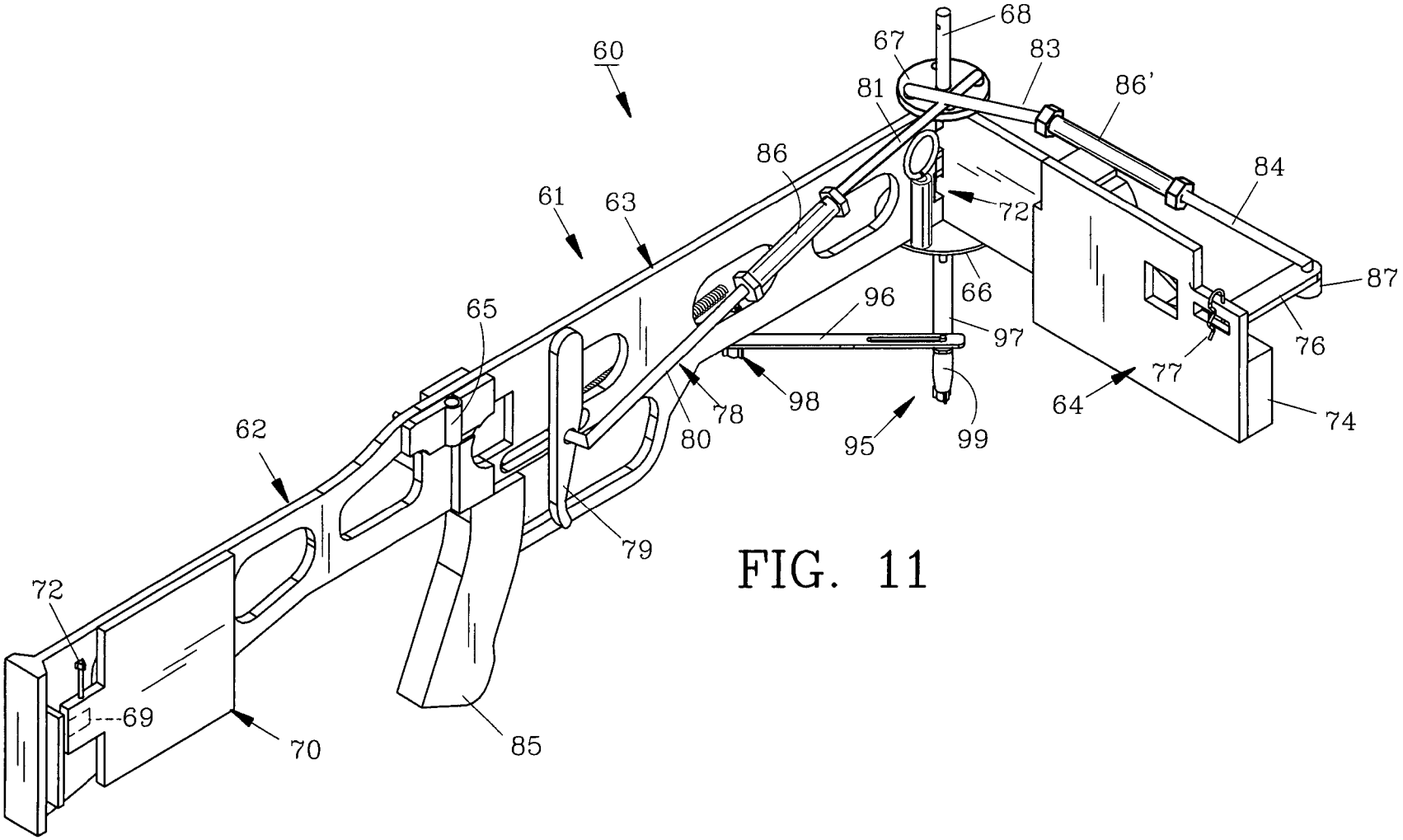
FIG. 11 shows the preferred pivotable shoulder stock of the invention in a rear, top left side perspective view with the handgun section rotated approximately ninety degrees (90°) clockwise.
Figure 12:
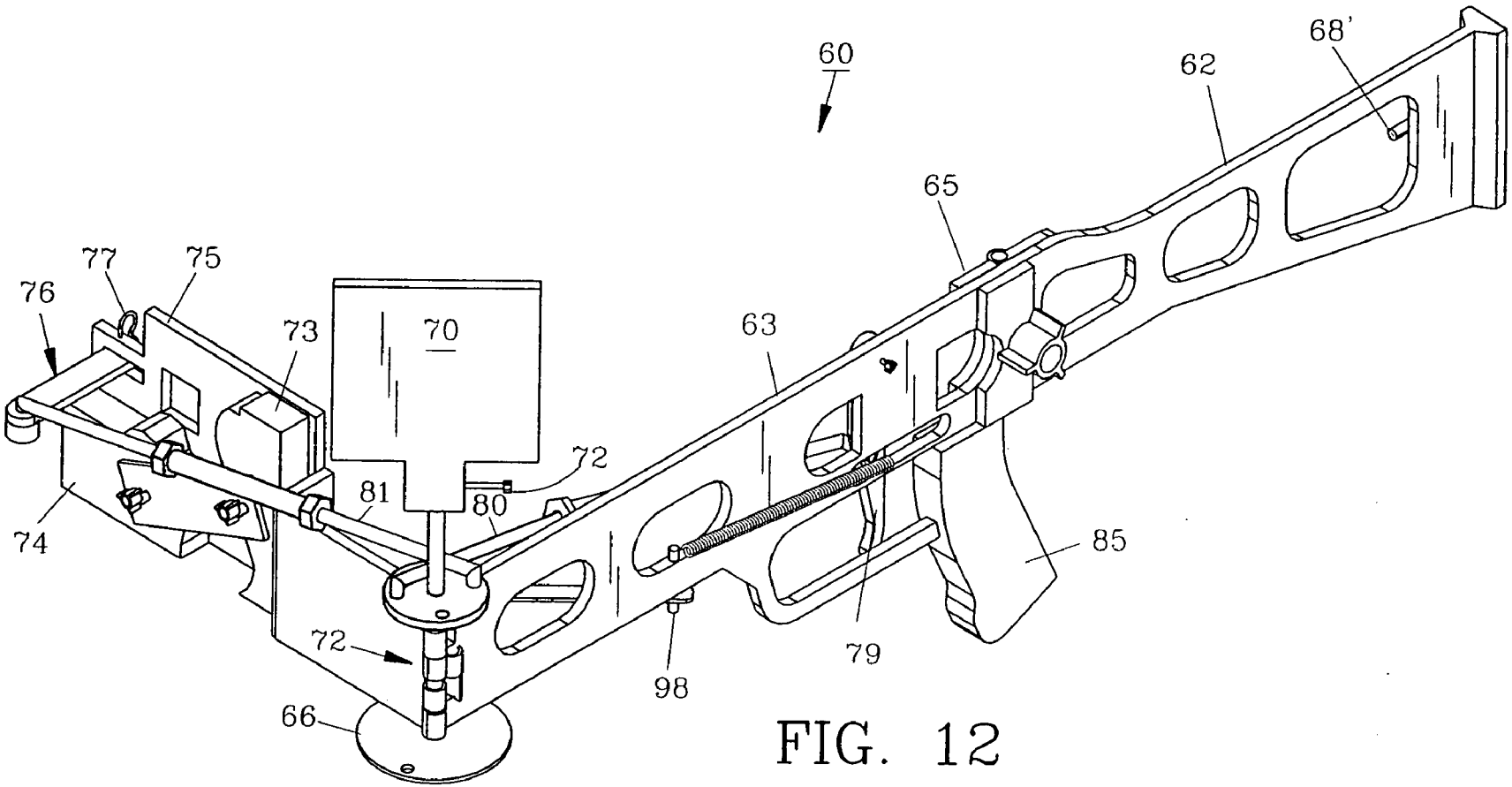
FIG. 12 illustrates a front, top right side perspective view of the preferred pivotable shoulder stock as seen in FIG. 11 but with the mirror attached at the crank.

In the preferred form of the invention seen in FIGS. 11-15, pivotable shoulder stock 60 includes shoulder section 61 hingedly joined to handgun section 64 by stud 68, joined similarly to that as seen in FIG. 10 regarding pivotable shoulder stock 10. Shoulder section 61 includes first section 62 and second section 63 hingedly affixed by hinge 65. Disk 66 is positioned on the bottom of and is rigidly affixed to handgun section 64 while circular crank 67 is attached to stud 68. Stud 68 is received within mirror socket 69 (FIG. 11) of mirror 70 for aiming purposes as seen for example, in FIGS. 12, 13 and 14, bolt 72 is provided to tighten mirror 70 on stud 68 once positioned as desired. When not needed, bolt 72 as shown in FIGS. 11 and 12 can be rotated to loosen and remove mirror 70 as required. Once removed from stud 68, mirror 70 can be affixed to shoulder section 62 as seen in FIG. 11 by way of stud 68' (FIGS. 12 and 13) receivable in mirror socket 69. As would be understood, mirror 70 can be rotated on stud 68 to any of a variety of positions in order to aim a pistol (not shown) mounted on handgun section 64 as foldable shoulder stock 60 can be pivoted in many positions as earlier described for shoulder stock 10 for left, right or linear firing.

Figure 13:
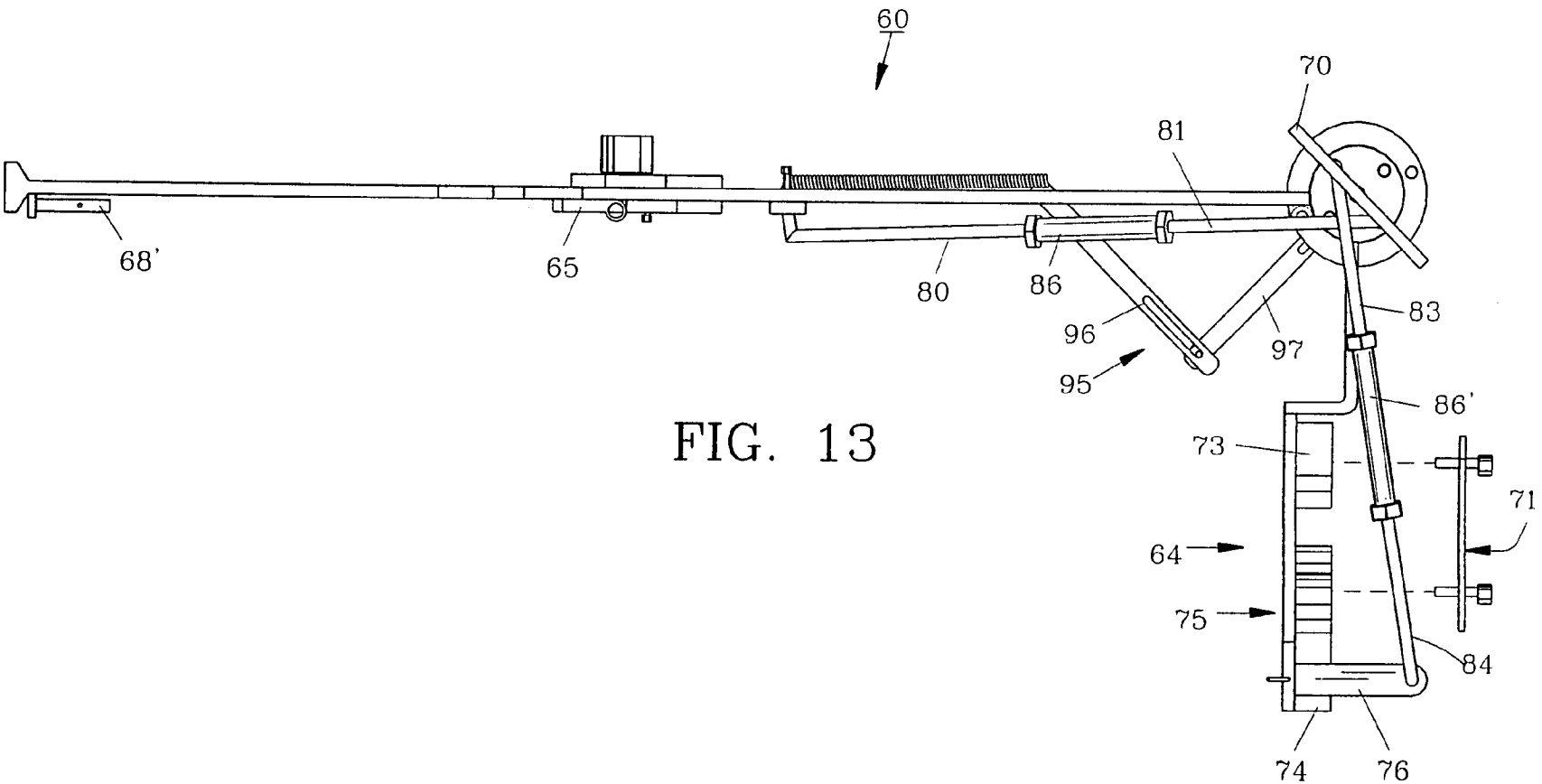
FIG. 13 demonstrates a top plan view of the pivotable shoulder stock as shown in FIG. 12 with the handgun clamp exploded therefrom.
Figure 14:
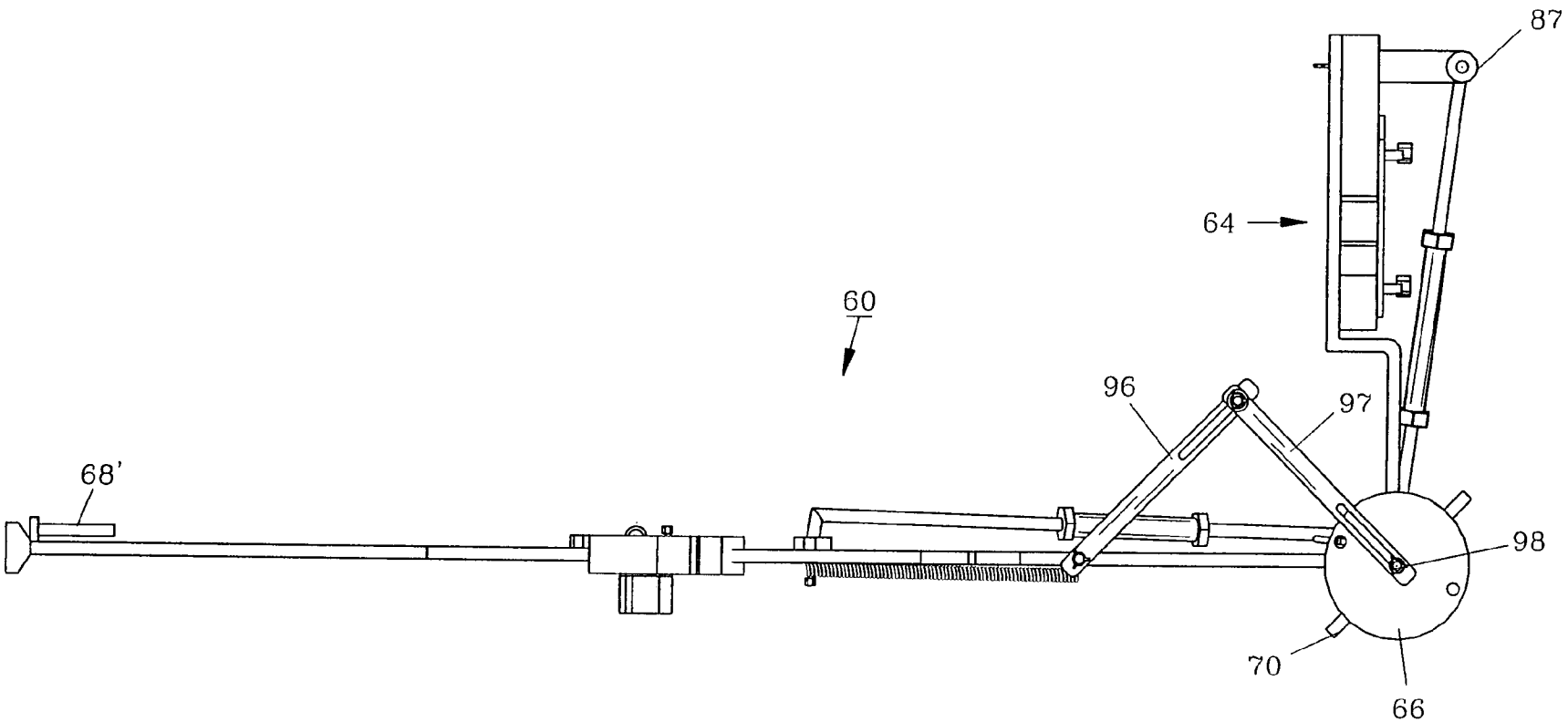
FIG. 14 features a bottom plan view of the pivotable shoulder stock as shown in FIG. 12 with the handgun clamp attached.

Handgun section 64 has a somewhat Z-shape as shown from the top in FIG. 13 and includes gun supports 73, 74 which are formed of a rigid polymeric material and are affixed with bolts or otherwise (not shown) to backplate 75. Gun supports 73, 74 are approximately the thickness of a handgun handle and are configured to conform to the contours of the particular handgun used. Trigger bar 76 shown in FIGS. 11-14 is pivotably joined to backplate 75 by spring clip 77 as hereinbefore described for shoulder stock 10 with trigger lever 47. Trigger bar 76 is operated by trigger mechanism 78 which includes stock trigger 79 pivotably joined to first trigger rod 80 which is joined to second trigger rod 81 by standard turnbuckle 86. First trigger rod 80 is rotatably joined to stock trigger 79 while second trigger rod 81 is rotatably joined to crank 67. Crank 67 could also have a shape other than circular as earlier described with crank 30. Trigger mechanism 78 further comprises third trigger rod 83 and fourth trigger rod 84 joined together by standard turnbuckle 86'. Third trigger rod 83 is rotatably connected to crank 67 while fourth trigger rod 84 is rotatably connected to trigger bar 76 with nut 87 as shown for example in FIGS. 11 and 14. Thus by grasping stock handle 85 shown in FIG. 11, stock trigger 79 can be pulled to operate trigger rods 80, 81 adjustably joined by turnbuckle 86 causing crank 67 to rotate and pull trigger rods 83, 84 adjustably joined by turnbuckle 86' thereby rotating trigger bar 76 to fire the mounted pistol (not shown) in FIGS. 11-14 such as when firing around a building or other obstacle as previously described for shoulder stock 10. As would be understood, trigger bar 76 applies pressure to the mounted pistol trigger, as in normal firing.

Figure 15:
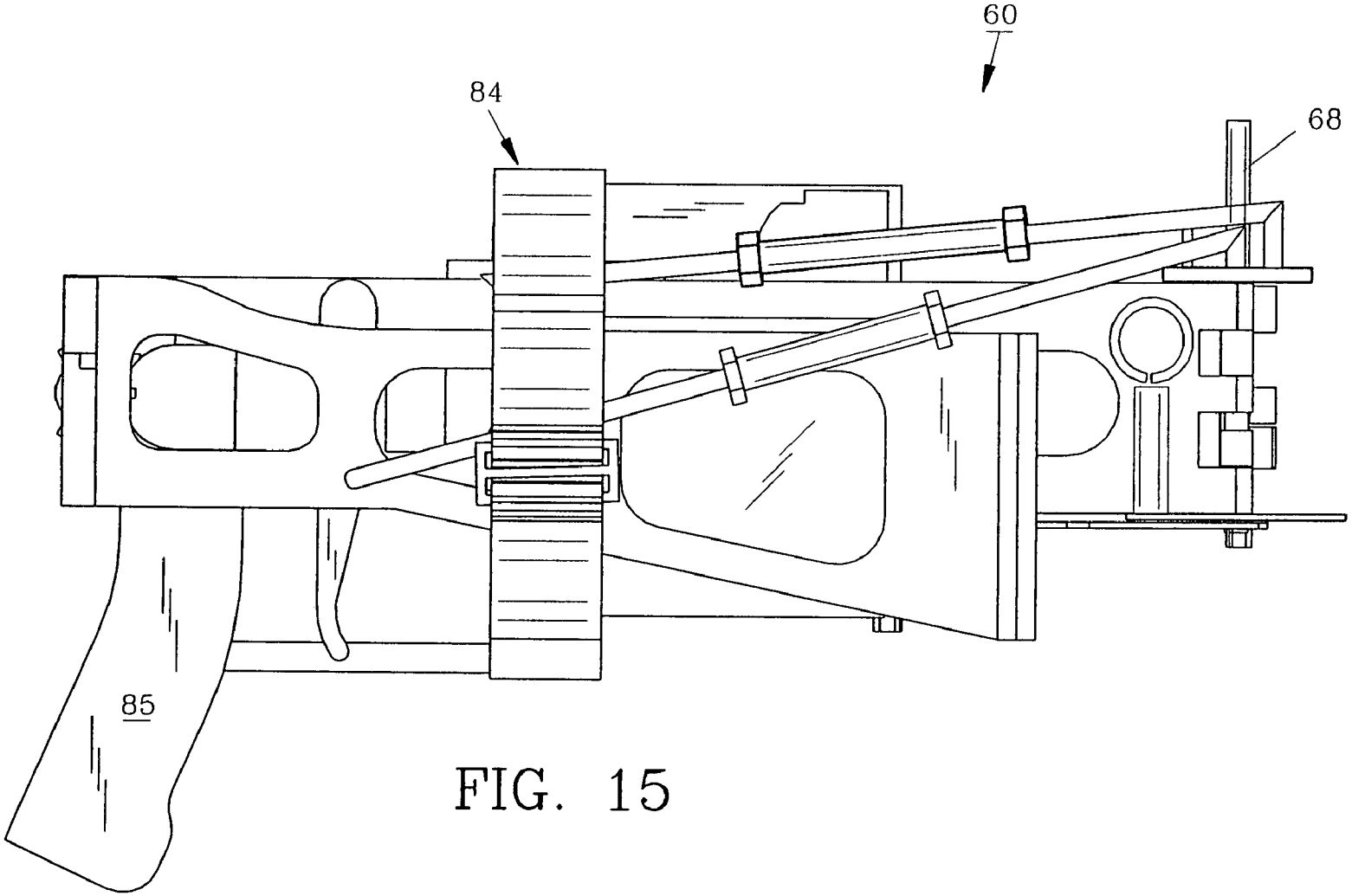
FIG. 15 depicts a side elevational view of the pivotable shoulder stock as shown in FIG. 11 as folded for compact carrying or storage purposes.

For storage or transport, preferred shoulder stock 60 can be folded at joint 72 (FIGS. 11 and 12) formed between shoulder section 61 and handgun section 64 and at hinge 65 (FIGS. 12 and 13) between first section 62 and second section 63 into a compact arrangement as seen in FIG. 15. As desired, a strap such as nylon strap 84 can be tightened through the attached buckle to secure pivotable shoulder stock 60 in its compact, folded configuration.

As would be understood, trigger rod sections 81, 83 may be removed from crank 67 during the folding process. Mirror 70 can likewise be removed from stud 68 (FIG. 15) and be affixed to mirror stud 68' (FIGS. 12 and 13) on first shoulder section 62 as seen in FIG. 11. In FIG. 13, preferred adjustable brace 95 is formed from first brace section 96 and second brace section 97 which are rotatably joined to respectively, shoulder section 61 (FIG. 11) and stud 68 (FIG. 14) by conventional wing nut brace bolts 98 seen in FIGS. 11, 12 and 14. First brace section 96 and second brace section 97 each include a groove (not shown) to assist in rotational allowance of brace 95 during positioning of handgun section 64 relative to shoulder section 63. Brace handle 99 is threadably joined to brace sections 96 and 97 and is used to stabilize shoulder stock 60 in a desired position during handgun firing, and can be loosened for folding of shoulder stock 60.

The illustrations and examples provided herein are for explanatory purposes and are not intended to limit the scope of the appended claims.

I claim:

1. A stock for a handgun comprising:

a shoulder section, a handgun section, said handgun section for containing a handgun, said handgun section pivotally joined to said shoulder section, a brace, said brace joined to said shoulder section and to said handgun section, a trigger mechanism, said trigger mechanism affixed to said shoulder section, a crank, said crank rotatably mounted on said stock, said trigger mechanism connected to said crank and to the handgun whereby operating said trigger mechanism will fire the handgun.

2. The handgun stock of claim 1 wherein said crank is circular.

3. The handgun stock of claim 1 wherein said trigger mechanism comprises a first rod, a second rod, said first rod and said second rod connected to said crank, and said second rod connected to the handgun.

4. The handgun stock of claim 1 wherein said shoulder section comprises a first section and a second section, said first section pivotably joined to said second section.

5. The handgun stock of claim 1 further comprising an adjustable handgun retainer, said handgun retainer affixed to said handgun section for securing a handgun thereto.

6. The handgun stock of claim 5 wherein said handgun retainer comprises a strap.

7. The handgun stock of claim 5 wherein said handgun retainer comprises a clamp.

8. The handgun stock of claim 1 further comprising a handle, said handle connected to said brace.

9. A stock for a handgun comprising: a shoulder section, a handgun section, a brace, said brace joined to said shoulder section and to said handgun section, said handgun section for containing a handgun, said handgun section pivotally joined to said shoulder section, a trigger mechanism, said trigger mechanism affixed to said shoulder section, a crank, said crank rotatably mounted on said handgun section, said trigger mechanism comprising a first rod and a second rod, said first rod and said second rod each connected to said crank, said second rod connected to the handgun whereby operating said trigger mechanism will fire the handgun.

10. The handgun stock of claim 9 further comprising an adjustable handgun retainer, said handgun retainer affixed to said handgun section.

11. The handgun stock of claim 9 further comprising a mirror, said mirror attached to said handgun section for viewing a target.

12. The handgun stock of claim 9 further comprising a handle, said handle attached to said brace.

13. The handgun stock of claim 9 further comprising a disk, said disk attached to said handgun section.

14. The handgun stock of claim 13 wherein said disk defines a series of apertures, a pivot pin, said pivot pin for engaging one of said apertures for selectively locking said handgun section relative to said shoulder section.

* * * * *